US010833417B2

(12) United States Patent
Leung et al.

(10) Patent No.: US 10,833,417 B2
(45) Date of Patent: Nov. 10, 2020

(54) FILTERING DIELECTRIC RESONATOR ANTENNAS INCLUDING A LOOP FEED STRUCTURE FOR IMPLEMENTING RADIATION CANCELLATION

(71) Applicant: City University of Hong Kong, Kowloon (HK)

(72) Inventors: Kwok Wa Leung, Kowloon Tong (HK); Yan Ting Liu, Kowloon Tong (HK); Jian Ren, Kowloon Tong (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 16/038,718

(22) Filed: Jul. 18, 2018

(65) Prior Publication Data

US 2020/0028231 A1 Jan. 23, 2020

(51) Int. Cl.

| | |
|---|---|
| ***H01Q 9/04*** | (2006.01) |
| ***H01P 1/203*** | (2006.01) |
| ***H01Q 5/50*** | (2015.01) |
| ***H01P 1/20*** | (2006.01) |
| ***H01Q 1/38*** | (2006.01) |
| ***H01P 7/10*** | (2006.01) |

(52) U.S. Cl.

CPC ..... *H01Q 9/0485* (2013.01); *H01P 1/2002* (2013.01); *H01P 1/20309* (2013.01); *H01P 1/20381* (2013.01); *H01P 7/105* (2013.01); *H01Q 1/38* (2013.01); *H01Q 5/50* (2015.01); *H01Q 9/0492* (2013.01)

(58) Field of Classification Search

CPC ..... H01Q 9/0485; H01Q 4/0492

See application file for complete search history.

(56) References Cited

U.S. PATENT DOCUMENTS

| | | | | |
|---|---|---|---|---|
| 5,719,539 | A | 2/1998 | Ishizaki et al. | |
| 5,905,420 | A | 5/1999 | Tsujiguchi et al. | |
| 6,020,799 | A | 2/2000 | Ishizaki et al. | |
| 6,147,647 | A * | 11/2000 | Tassoudji et al. | H01Q 9/0492 333/219.1 |
| 6,258,462 | B1 | 7/2001 | Kagata et al. | |
| 6,304,156 | B1 | 10/2001 | Ishizaki et al. | |
| 6,314,276 | B1 | 11/2001 | Hilgers et al. | |
| 6,452,565 | B1 * | 9/2002 | Kingsley et al. | H01Q 1/40 343/700 MS |
| 6,549,094 | B2 | 4/2003 | Takagi et al. | |
| 6,569,795 | B2 | 5/2003 | Kono et al. | |
| 6,579,817 | B2 | 6/2003 | Harada et al. | |
| 6,621,381 | B1 | 9/2003 | Kundu et al. | |
| 6,621,383 | B2 | 9/2003 | Nakamura et al. | |
| 7,038,557 | B2 | 5/2006 | Nakamura et al. | |

(Continued)

*Primary Examiner* — Benny T Lee

(74) *Attorney, Agent, or Firm* — Norton Rose Fulbright US LLP

(57) ABSTRACT

Systems and methods which provide filtering dielectric resonator antenna (FDRA) configurations implementing radiation cancellation are disclosed. Embodiments of a FDRA provide implementations of dielectric resonator antennas (DRAs) which are configured with a loop feed structure facilitates radiation cancellation to provide radiation nulls at frequencies outside of a desired passband to thereby implement radiation cancellation for filtering functionality of the FDRA. FDRAs of embodiments may be variously polarized, such as to provide linear polarization or circular polarization.

30 Claims, 11 Drawing Sheets

(56) References Cited

U.S. PATENT DOCUMENTS

| | | | | |
|---|---|---|---|---|
| 7,180,473 | B2 | 2/2007 | Horie et al. | |
| 7,423,591 | B2 * | 9/2008 | Fox | H01Q 5/357 343/700 MS |
| 8,207,893 | B2 | 6/2012 | Baliarda et al. | |
| 8,471,772 | B2 | 6/2013 | Puente Baliarda et al. | |
| 8,558,741 | B2 | 10/2013 | Baliarda et al. | |
| 8,610,627 | B2 | 12/2013 | Puente Baliarda et al. | |
| 8,738,103 | B2 | 5/2014 | Puente Baliarda et al. | |
| 8,893,428 | B2 | 11/2014 | Dykstra | |
| 8,912,494 | B2 | 12/2014 | Chervenak et al. | |
| 9,099,773 | B2 | 8/2015 | Puente Baliarda et al. | |
| 9,331,382 | B2 | 5/2016 | Baliarda et al. | |
| 9,673,507 | B2 | 6/2017 | Ramachandran et al. | |
| 9,899,727 | B2 | 2/2018 | Puente Baliarda et al. | |

* cited by examiner

FILTERING DIELECTRIC RESONATOR ANTENNAS INCLUDING A LOOP FEED STRUCTURE FOR IMPLEMENTING RADIATION CANCELLATION

TECHNICAL FIELD

The invention relates generally to wireless communications and, more particularly, to filtering dielectric resonator antennas implementing radiation cancellation, embodiments of which may be variously polarized such as to provide linear polarization or circular polarization.

BACKGROUND OF THE INVENTION

In recent years, antennas and bandpass filters (BPFs) have been integrated to provide different filtering antenna configurations to meet various objectives of technologies used in wireless communication applications. The combination of filter and antenna to achieve radiating and filtering functions within one design has received attention in attempting to improve the performance (e.g., reduce insertion loss) and reduce size (e.g., reduce overall antenna volume) of the antenna.

A common method to obtain a filtering antenna is to use traditional filter synthesis method and coupling matrix theory. In this method, the antenna is regarded as a radiator as well as the last-stage resonator of BPFs simultaneously. Multiple resonators are still needed and hence reduction in size and insertion loss is quite limited.

Most of the filtering antenna designs aim to obtain linear polarized (LP) fields. However, in some applications, such as satellite communications, circular polarized (CP) transmission is needed (e.g., to resist interference).

BRIEF SUMMARY OF THE INVENTION

The present invention is directed to systems and methods which provide filtering dielectric resonator antenna (FDRA) configurations implementing radiation cancellation. Embodiments of a FDRA provide implementations of dielectric resonator antennas (DRAs) which are configured to provide radiation nulls at frequencies outside of a desired passband to thereby implement radiation cancellation for filtering functionality of the FDRA.

A FDRA in accordance with concepts of the present invention may comprise a dielectric resonator (DR), such as may comprise a block of ceramic or other suitable dielectric material of various shapes, disposed on a ground plane and coupled to a signal feed path, such as may comprise a microstrip feed line. A loop feed structure is coupled to the signal feed path of a FDRA of embodiments of the invention, wherein the loop feed structure facilitates radiation cancellation in accordance with concepts of the invention. For example, a DRA structure of a FDRA of embodiments of the invention may be operated (e.g., excitation of the DR in the hybrid electromagnetic (HEM) mode) to produce a radiation pattern of a horizontal magnetic dipole. A loop feed structure of such a FDRA configured in accordance with embodiments may correspondingly produce a radiation pattern of a horizontal dipole having a magnitude substantially that of the DR magnetic dipole and substantially opposite phase. Accordingly, radiation nulls may be obtained according to embodiments of a FDRA through the combining of the DR magnetic dipole and the loop feed structure magnetic dipole. In accordance with embodiments of a FDRA, such radiation nulls are provided at frequencies to facilitate filtering functionality of the FDRA. Such radiation cancellation configurations of FDRAs in accordance with concepts of the present invention facilitate antenna implementations having very compact size with reduced insertion loss.

FDRAs of embodiments of the invention may be variously polarized. Accordingly, although filtering antenna designs typically obtain linearly polarized fields, FDRAs provided in accordance with concepts of the present invention may provide linear polarization or circular polarization. For example, a linear polarized (LP) FDRA implementation may be provided using a cylindrical DR configuration. Alternatively, a circular polarized (CP) FDRA implementation may be provided using an elliptical DR configuration.

Aspects (e.g., dielectric constants, shapes, surface features, etc.) of DRs of FDRAs according to embodiments may be configured to facilitate one or more operational aspect of a respective FDRA implementation. For example, in addition to being configured in a particular shape, such as the aforementioned cylindrical or elliptical DR configurations, a DR may be notched, furrowed, scored, slit, etc. for configuring one or more operational aspect of a FDRA (e.g., to enhance axial ratio (AR) bandwidth).

As may be appreciated from the foregoing, FDRAs provided in accordance with embodiments of the present invention realize advantages of DRA implementations, such as small size, light weight, ease of excitation, low cost, and high efficiency. Moreover, FDRAs of embodiments herein are configured to provide filtering functionality through radiation cancellation, realizing further size advantages and reduced insertion loss.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Dielectric resonator antenna (DRA) technology is adapted to provide filtering dielectric resonator antenna (FDRA) configurations implementing radiation cancellation according to concepts of the present invention. For example, FDRAs of embodiments are configured to provide radiation nulls at frequencies outside of a desired passband to thereby implement radiation cancellation for filtering functionality of the FDRA. In operation according to embodiments of the invention, radiation nulls for FDRA radiation cancellation is obtained through the combining of two parallel equivalent magnetic dipoles from the dielectric resonator (DR) and a loop structure, which have substantially the same magnitude and opposite phase. FDRAs of embodiments may, for example, comprise a loop feed structure configured to facilitate radiation cancellation in accordance with concepts of the invention. As will be better understood from the examples that follow, such a loop feed structure may be utilized to produce a magnetic dipole parallel to that of the DR mode, having substantially the same magnitude and substantially opposite phase (referred to herein as an opposite-phase equivalent magnetic dipole) at one or more frequencies (e.g., frequencies outside a passband of the FDRA, cutoff frequencies of the FDRA, etc.). Accordingly, radiation nulls may be obtained according to embodiments of a FDRA through the combining of the DR mode and the loop feed mode to produce radiation nulls at certain frequencies to facilitate filtering functionality of the FDRA.

FDRAs of embodiments of the invention may be variously polarized. Accordingly, examples of linear polarized (LP) FDRA implementations provided using a cylindrical DR configuration and circular polarized (CP) FDRA implementations provided using an elliptical DR configuration are shown below to aid in understanding concepts of the present invention. In particular, as described with respect to the exemplary embodiments below, prototypes were designed, fabricated, and measured in each case for 2.4 GHz WLAN applications, wherein peak realized gains of 5.86 dBi and 5.1 dBic, and out-of-band suppression levels of more than 19 dB and 18 dB were observed in the measurement for the LP and CP cases respectively. As can be seen from the discussion that follows, the LP FDRA and CP FDRA of the exemplary embodiments implement radiation cancellation to facilitate filtering functionality of the respective FDRAs.

Figure 1A:
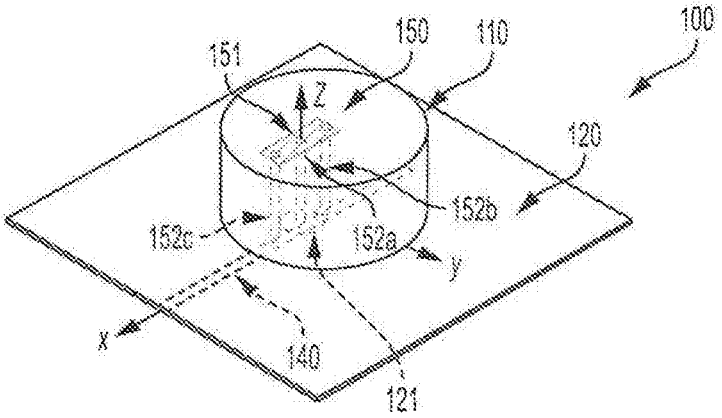
FIGS. 1A-1C show a linear polarized filtering dielectric resonator antenna configuration in accordance with embodiments of the present invention.
Figure 1B:
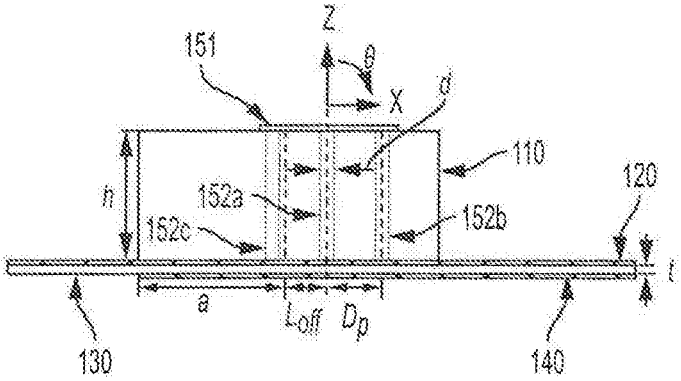
Figure 1C:
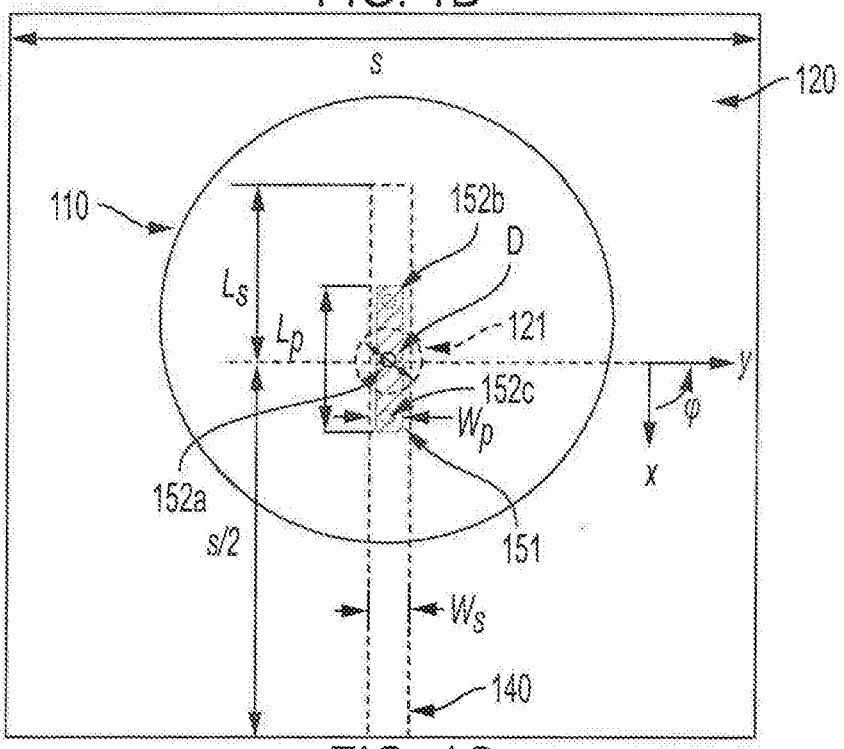

FIGS. 1A-1C (in which the x-axis, y-axis, and z-axis of the a 3-dimensional coordinate system are variously indicated for reference) show a LP FDRA configuration in accordance with concepts of the present invention. FDRA 100 of FIGS. 1A-1C comprises DR 110 disposed on ground plane 120 and coupled to microstrip feed line 140, wherein the symmetrical cylindrical shape of DR as well as linear line configuration of the loop structure facilitate linear polarization of the FDRA. As will be better understood from the discussion below, FDRA 100 illustrated in FIGS. 1A-1C is configured to implement radiation cancellation in accordance with concepts here.

DR 110 of the illustrated embodiment of FDRA 100 is implemented as a cylindrical DR, such as may comprise a block of ceramic or other suitable dielectric material, with a radius of a, height of h as shown in FIG. 1B, and dielectric constant of $\varepsilon_r$. DR 110 of FDRA 100 shown in FIGS. 1A-1C is disposed upon ground plane 120 to provide a DRA structure, wherein the resonant frequency is determined by the overall physical dimensions of the DR and the dielectric constant of the material. It should be appreciated that DR 110 of the illustrated embodiment of FDRA 100 is disposed on ground plane 120 with an offset of $L_{off}$ (FIG. 1B) from the center of the ground plane (e.g., along the axis (x-axis) as shown in FIG. 1B of the microstrip feed line) to facilitate excitation of LP fields. The DR offset is implemented in accordance with embodiments of the invention for facilitating better (e.g., more symmetrical) filtering performance. For example, the DR offset has different effects on the DR $HEM_{11\delta}$ mode and loop mode, wherein the DR $HEM_{11\delta}$ mode and loop mode will counteract each other at a new frequency when the DR is offset in accordance with embodiments of the invention.

Ground plane 120 of the illustrated embodiment comprises a square conductive surface, such as may comprise a copper sheet or other conductive plane, having a side length of s as shown in FIG. 1C. It should be appreciated that, although ground plane 120 is shown as a square conductive surface, embodiments of the invention may comprise a ground plane of other shapes (e.g., regular and symmetrical shapes). Ground plane 120 shown in FIGS. 1A-1C is supported by substrate 130 (FIG. 1B), such as may comprise a non-conductive structural material (e.g., fire retardant printed circuit board laminates, such as FR4). Substrate 130 of the illustrated embodiment has a thickness of t (FIG. 1B) and dielectric constant of $\varepsilon_{rs}$ (e.g., commercially available substrate material having a thickness of 1.575 mm and a dielectric constant of 2.33 may be utilized according to embodiments). Although the shape and side length, s, of substrate 130 show in FIGS. 1A-1C corresponds to that of ground plane 120, it should be appreciated that substrate 130 of embodiments may be sized and/or shaped differently than ground plane 120. However, embodiments providing a smallest size implementation of FDRA 100 may size and shape substrate 130 so as not to exceed the size of ground plane 120.

In addition to providing structural support for ground plane 120, and FDRA 100 in general, substrate 130 of embodiments provides a dielectric used in forming microstrip feed line 140 providing a signal feed path for FDRA 100. In the embodiment illustrated in FIGS. 1A-1C, microstrip feed line 140 comprises a conductive strip, such as may comprise a copper trace or other conductive line, having a width of $W_s$ (FIG. 1C) disposed on the back of substrate 130 with respect to ground plane 120. In accordance with embodiments of the invention, microstrip feed line 140 may be configured to implement a 50-Ω microstrip feedline for FDRA 100 (e.g., a width of the microstrip feed line is selected to provide an impedance of 50Ω based upon the characteristics of the particular substrate used).

It should be appreciated that microstrip feed line 140 of FIGS. 1A-1C is disposed in juxtaposition with slot 121 (FIGS. 1A and 1C) formed in ground plane 120 to implement a slot-fed DRA configuration of FDRA 100. Slot 121 of the illustrated embodiment, for example, comprises a circular slot etched into ground plane 120 at its center. In the illustration of FIG. 1C, slot 121 is centered a distance s/2 from an edge of ground plane 120, and microstrip feed line 140 extends a distance $L_s$ beyond the center of slot 121.

In accordance with embodiments, microstrip feed line 140 coupled to DR 110 via slot 121 may be used to excite the DR, such as to operate the DRA structure of FDRA 100 in one or more modes thereof. For example, embodiments may operate to excite the DR 110 in its $HEM_{11\delta}$ mode, producing a radiation pattern of a horizontal magnetic dipole.

A loop feed structure is provided to configure FDRA 100 of FIGS. 1A-1C to implement radiation cancellation. A loop antenna can be operated to produce a radiation pattern of a magnetic dipole normal to the plane of the loop. Accordingly, loop feed structure 150 (FIG. 1A) of embodiments is configured to provide a loop antenna structure operable to produce a radiation pattern of a magnetic dipole normal to the plane of the loop, wherein radiation nulls are obtained as a result of the magnetic dipoles of DR 110 and loop feed structure 150 having substantially equal magnitude and substantially opposite phase (i.e., phase difference of 180°).

Loop feed structure 150 of the illustrated embodiment comprises plate 151 and posts 152*a*, 152*b* and 152*c* coupled to microstrip feed line 140 to provide a loop antenna structure. Plate 151 of loop feed structure 150 of embodiments comprises a liner or straight-line conductive plate, such as may comprise a copper strip or other conductive member, having a length of $L_p$ and width of $W_p$ as shown in FIG. 1C and is disposed in a plane parallel to ground plane 120. It should be appreciated that the length of plate $L_p$ as implemented according to embodiments effects the lower stopband and left null, but has little effect on the upper stopband and right null. Posts 152*a*-152*c* of embodiments comprise conductive posts, such as may comprise a copper tube or other conductive member, each having diameter of d (FIG. 1B) disposed between and orthogonal to plate 151 and ground plane 120. As shown in FIG. 1B, each of posts 152*a*-152*c* are disposed through (i.e., penetrating) DR 110. In the illustrated embodiment, post 152*a* extends through slot 121 and interfaces with microstrip feed line 140 (e.g., soldered to a surface of the conductive strip of microstrip feed line) while posts 152*b* and 152*c* are disposed at a distance of $D_p$ (e.g., $D_p$ may be in the range of r/3 to r/2, wherein r (not labeled in the figures) is the radius of the DR) from post 152*a* and interface with ground plane 120 (e.g., soldered to a surface of the ground plane). Embodiments of the invention may, for example, utilize posts having a diameter of less than 3 mm to facilitate good impedance matching and flat antenna gain in the passband. Posts 152*a*-152*c* are each interfaced with plate 151 (e.g., soldered to a surface of the plate), thereby forming two loops of the loop feed structure. Plate 151 of embodiments is provided in a linear or straight-line configuration for implementing a loop feed structure facilitating excitation of LP fields.

An exemplary implementation of a LP FDRA configured in accordance with FDRA 100 above was designed for operation at the 2.4 GHz WLAN band. ANSYS HFSS, high frequency electromagnetic field simulation software, was used to design the DRA of this exemplary FDRA implementation. In particular, a prototype LP FDRA, configured in accordance with FIGS. 1A-1C with the parameters a=18 mm, h=16.9 mm, d=2 mm, t=1.57 mm, s=100 mm, $W_p$=3.5 mm, $L_p$=18.4 mm, $L_{off}$=2.2 mm, $D_p$=6.5 mm, $L_s$=21.2 mm, $W_s$=4.7 mm, $\varepsilon_r$=10, and $\varepsilon_{rs}$=2.33, was fabricated.

Figure 2:
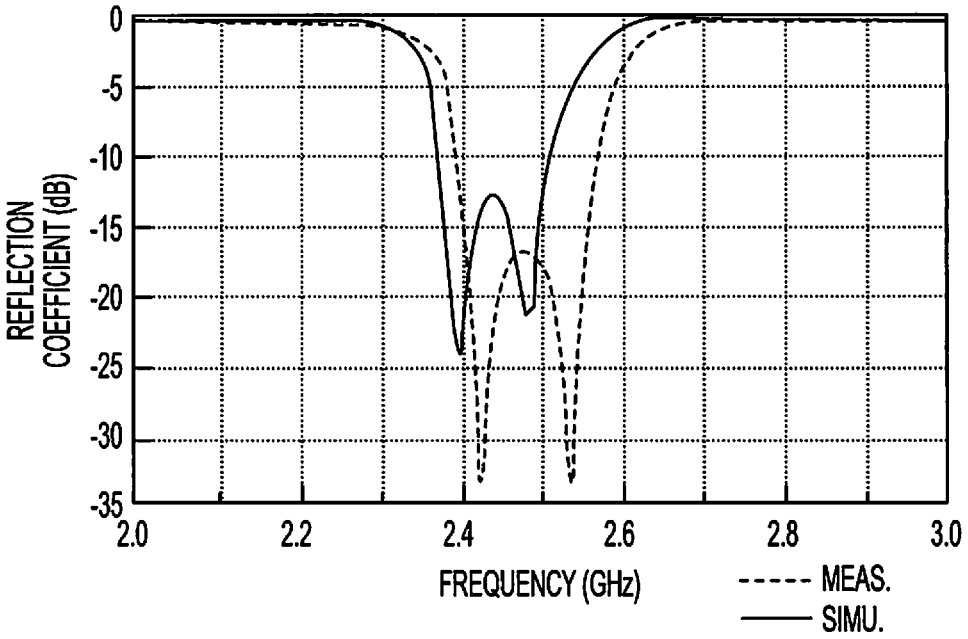
FIG. 2 shows the measured and simulated reflection coefficients of an exemplary implementation of a linear polarized filtering dielectric resonator antenna.

The reflection coefficient for the exemplary LP FDRA implementation was measured using an Agilent 8753ES vector network analyzer. FIG. 2 shows the measured (i.e. MEAS.) and simulated (i.e. SIMU.) reflection coefficients in dB vs. Frequency in GHz of the exemplary LP FDRA, wherein very sharp selectivity can be observed. The measured 10-dB impedance bandwidth ($|S11| \leq -10$ dB) is 7.2% (2.40-2.58 GHz), which agrees reasonably with the simulated result of 5.7% (2.38-2.52 GHz) and covers the entire 2.4-GHz WLAN band (2.40-2.48 GHz). The measured impedance bandwidth is wider than the simulated result, which should be mainly attributed to inevitable air gap between the DRA and ground plane.

Figure 3:
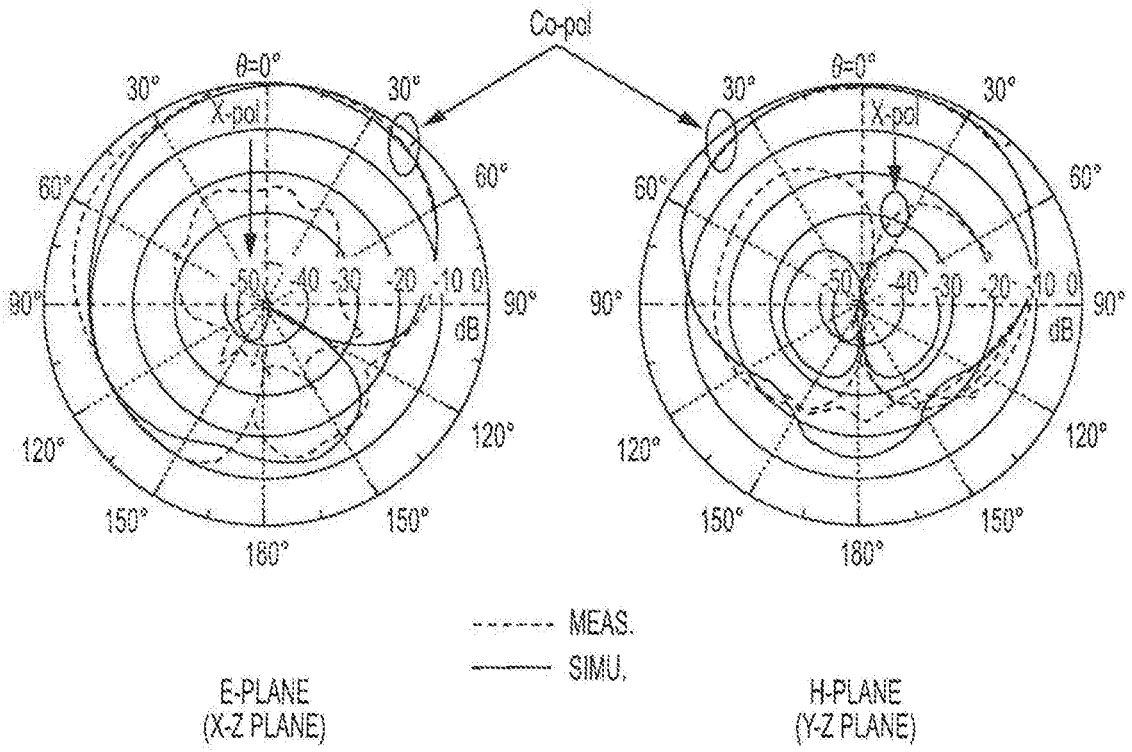
FIG. 3 shows the measured and simulated normalized radiation patterns of an exemplary implementation of a linear polarized filtering dielectric resonator antenna.

The antenna gain, antenna efficiency, and radiation pattern for the exemplary LP FDRA implementation were measured using a Satimo StarLab system. The measured (i.e. MEAS.) and simulated (i.e. SIMU.) normalized radiation patterns of the DRA at 2.45 GHz are shown in FIG. 3. It can be seen in the graphs of FIG. 3 that typical broadside radiation patterns can be found as expected. The radiation pattern in E-plane (X-Z-plane, φ=0°, φ shown in FIGS. 1C and 6C) is not completely symmetric due to the asymmetry of the feedline and the offset of the DRA. Measured cross-polarized (i.e., X-pol) field in both E- and H-planes (H-plane or Y-Z plane, θ=0°, θ shown in FIGS. 1B and 6B) is very weak and it is more than 24 dB weaker than its co-polarized (i.e. Co-pol) counterpart in the boresight direction θ=0°.

Figure 4:
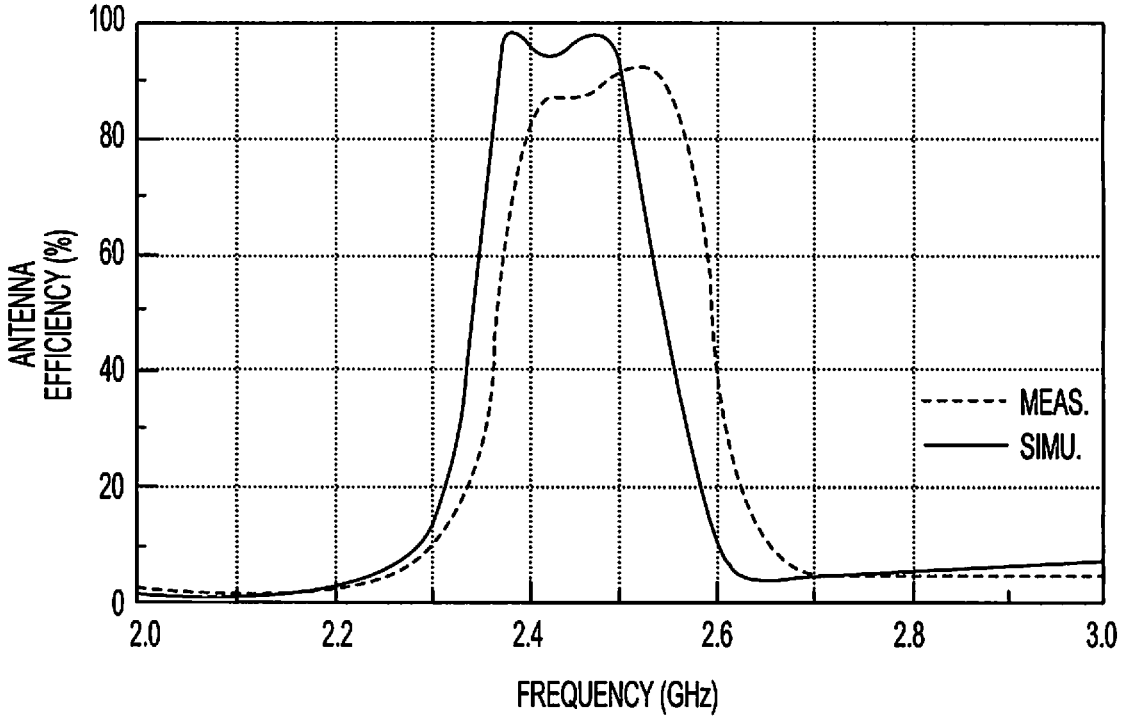
FIG. 4 shows the measured and simulated total efficiency of an exemplary implementation of a linear polarized filtering dielectric resonator antenna.

The measured (i.e. MEAS.) and simulated (i.e. SIMU.) total antenna efficiency in % vs. Frequency in GHz, with impedance matching being taken into consideration, are compared in FIG. 4. As can be seen in FIG. 4, two measured efficiency peaks appear at 2.42 and 2.53 GHz, which correspond to the two extrema of reflection coefficients in FIG. 2. Across the 10-dB impedance band (2.38-2.52 GHz), the simulated antenna efficiency is higher than 91%. The measured average result is higher than 86% in the passband with peak efficiency of 91.6%. By contrast, antenna efficiency is nearly zero in the stopband. This result implies that energy is radiated effectively only in the passband.

Figure 5:
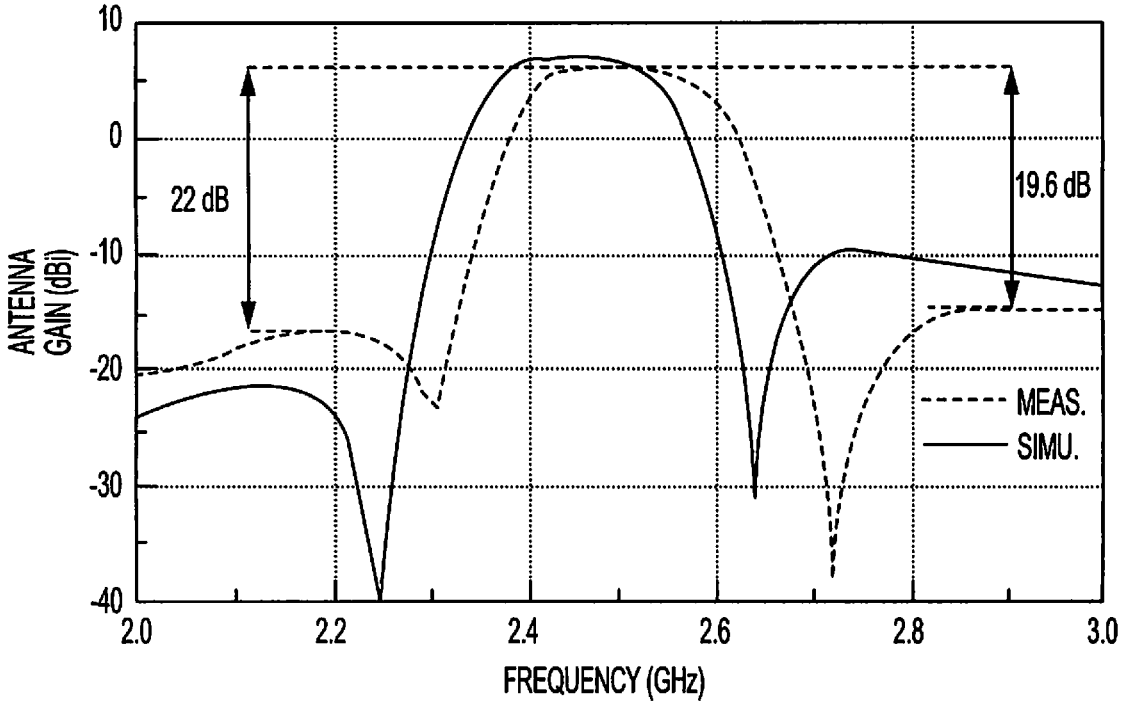
FIG. 5 shows the measured and simulated antenna gains in the boresight direction of an exemplary implementation of a linear polarized filtering dielectric resonator antenna.

FIG. 5 shows the measured (i.e. MEAS.) and simulated (i.e. SIMU.) antenna gains in dBi vs. Frequency in GHz in the boresight direction. As can be seen in the graphs of FIG. 5, good filtering responses are obtained by the exemplary LP FDRA implementation. The measured antenna gain is flat in the passband from 2.4 GHz to 2.58 GHz, with the maximum of 5.86 dBi at 2.5 GHz. Two radiation nulls are found at 2.31 GHz and 2.72 GHz, which are caused by radiation cancellation of two equivalent magnetic dipoles (e.g., opposite-phase equivalent magnetic dipoles of embodiments of the invention). Since there is no neighboring resonant mode in the near stopband, sharp roll-off rate and good out-of-band suppression is obtained. In the lower (2.0-2.3 GHz) and upper (2.7-3.0 GHz) stopbands, the measured out-of-band suppression levels are given by 22 dB and 19.6 dB, respectively. It should be appreciated that, although the antenna gain is measured only in the boresight direction, fields are negligible at any direction in the stopband. This can be verified from both high reflection level and low efficiency in the stopband, as shown in FIG. 2 and FIG. 4 respectively.

Figure 6A:
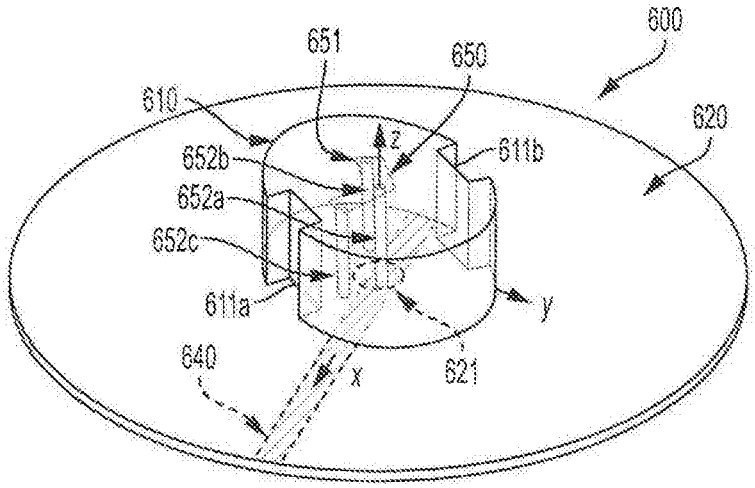
FIGS. 6A-6C show a circular polarized filtering dielectric resonator antenna configuration in accordance with embodiments of the present invention.
Figure 6B:
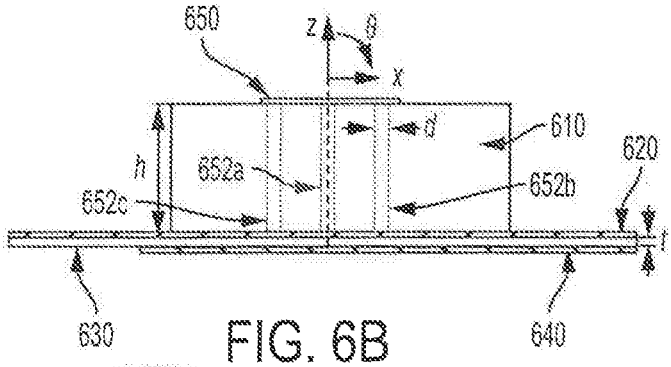
Figure 6C:
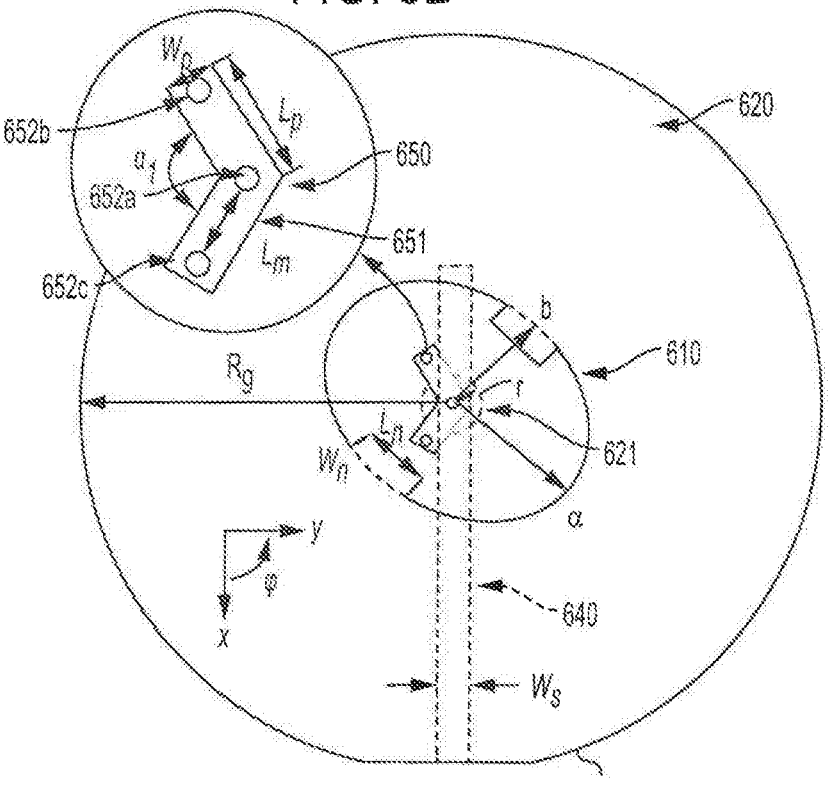

FIGS. 6A-6C in which the x-axis, y-axis, and z-axis of the a 3-dimensional coordinate system are variously indicated for reference) show a CP FDRA configuration in accordance with concepts of the present invention. FDRA 600 (FIG. 6A) of FIGS. 6A-6C comprises DR 610 disposed on ground plane 620 and coupled to microstrip feed line 640, wherein the elliptical DR rotated by 45° facilitates circular polarization (e.g., excites two degenerate modes) and notches along the minor axis of the elliptical DR enhance axial ratio bandwidth. As will be better understood from the discussion below, FDRA 600 illustrated in FIGS. 6A-6C is configured to implement radiation cancellation in accordance with concepts here.

DR 610 of the illustrated embodiment of FDRA 600 is implemented as an elliptical DR, such as may comprise a block of ceramic or other suitable dielectric material, with major/minor axis lengths of $\alpha$ and b (FIG. 6C) respectively, a height of h (FIG. 6B), and dielectric constant of $\varepsilon_r$. The elliptical shape of the illustrated embodiment of DR 610 is configured to facilitate excitation of CP fields. DR 610 of FDRA 600 shown in FIGS. 6A-6C is disposed upon ground plane 620 to provide a DRA structure, wherein the resonant frequency is determined by the overall physical dimensions of the DR and the dielectric constant of the material. It should be appreciated that DR 610 of the illustrated embodiment of FDRA 600 is disposed on ground plane 620 rotated by 45° (e.g., with respect to the axis (y-axis) as shown in FIGS. 6A and 6C of the microstrip feed line) to facilitate excitation of CP fields.

DR 610 of the embodiment illustrated in FIGS. 6A-6C is notched for configuring an operational aspect of FDRA 600. In particular, notches 611*a* and 611*b* as shown in FIG. 6A, each comprising quasi-rectangular areas with a length of $L_n$ and width of $W_n$ as shown in FIG. 6C, are disposed in DR 610 along the minor axis to enhance axial ratio (AR) bandwidth.

Ground plane 620 of the illustrated embodiment comprises an essentially round (e.g., part 622 as shown in FIG. 6C of the illustrated ground plane is flattened to facilitate subminiature version A (SMA) connector assembly) conductive surface, such as may comprise a copper sheet or other conductive plane, having a radius of $R_g$ as shown in FIG. 6C. It should be appreciated that, although ground plane 620 is shown as a round conductive surface, embodiments of the invention may comprise a ground plane of other shapes (e.g., regular and symmetrical shapes), although circular ground plane configurations may enhance antenna gain in circularly polarized implementations. Ground plane 620 shown in FIGS. 6A-6C is supported by substrate 630 (FIG. 6B), such as may comprise a non-conductive structural material (e.g., fire retardant printed circuit board laminates, such as FR4). Substrate 630 of the illustrated embodiment has a thickness of t (FIG. 6B) and dielectric constant of $\varepsilon_{rs}$ (e.g., commercially available substrate material having a thickness of 1.575 mm and a dielectric constant of 2.33 may be utilized according to embodiments). Although the size and radius, $R_g$, of substrate 630 show in FIGS. 6A-6C corresponds to that of ground plane 620, it should be appreciated that substrate 630 of embodiments may be sized and/or shaped differently than ground plane 620. However, embodiments providing a smallest size implementation of FDRA 600 may size and shape substrate 630 so as not to exceed the size of ground plane 620.

In addition to providing structural support for ground plane 620, and FDRA 600 in general, substrate 630 of embodiments provides a dielectric used in forming microstrip feed line 640 providing a signal feed path for FDRA 600. In the embodiment illustrated in FIGS. 6A-6C, microstrip feed line 640 comprises a conductive strip, such as may comprise a copper trace or other conductive line, having a width of $W_s$ (FIG. 6C) disposed on the back of substrate 630 with respect to ground plane 620 (e.g., a width of the microstrip feed line is selected to provide an impedance of 50Ω based upon the characteristics of the particular substrate used). In accordance with embodiments of the invention, microstrip feed line 640 may be configured to implement a 50-Ω microstrip feedline for FDRA 600.

It should be appreciated that microstrip feed line 640 of FIGS. 6A-6C is disposed in juxtaposition with slot 621 (FIG. 6A) formed in ground plane 620 to implement a slot-fed DRA configuration of FDRA 600. Slot 621 of the illustrated embodiment, for example, comprises a circular slot with a radius of r (FIG. 6A) etched into ground plane 620 at its center.

In accordance with embodiments, microstrip feed line 640 coupled to DR 610 via slot 621 may be used to excite the DR, such as to operate the DRA of FDRA 600 in one or more modes thereof. For example, embodiments may operate to excite the DR 610 in its $HEM_{11\delta}$ mode, producing a radiation pattern of a horizontal magnetic dipole.

A loop feed structure is provided to configure FDRA 600 of FIGS. 6A-6C to implement radiation cancellation. In particular, loop feed structure 650 of embodiments is configured to provide a loop antenna structure operable to produce a radiation pattern of a magnetic dipole normal to the plane of the loop, wherein radiation nulls are obtained as a result of the magnetic dipoles of DR 610 and loop feed structure 650 having substantially equal magnitude and substantially opposite phase (i.e., phase difference of 180°).

Loop feed structure 650 of the illustrated embodiment comprises plate 651 (FIGS. 6*a* and 6C) and posts 652*a*, 652*b*, 652*c* coupled to microstrip feed line 640 to provide a loop antenna structure. As shown in FIG. 6C, plate 651 of loop feed structure 650 of embodiments comprises a "V" shaped conductive plate, such as may comprise a copper strip or other conductive member, having arm lengths of $L_p$ and width of $W_p$ disposed in a plane parallel to ground plane 620. For example, in accordance with embodiments of the invention the arm length and width may be set as $L_p$=2b/3 and $W_p$=2d respectively, wherein b (FIG. 6C) and d (FIG. 6B) are the semi-minor axis length and post diameter respectively. Posts 652*a*-652*c* of embodiments comprise conductive posts, such as may comprise a copper tube or other conductive member, each having diameter of d disposed between and orthogonal to plate 651 and ground plane 620. As shown in FIG. 6B, each of posts 652*a*-652*c* are disposed through (i.e., penetrating) DR 610. In the illustrated embodiment, post 652*a* extends through slot 621 and interfaces with microstrip feed line 640 (e.g., soldered to a surface of the conductive strip of microstrip feed line) while posts 652*b* and 652*c* are disposed at a distance of $L_m$ as shown in FIG. 6C (e.g., $L_m$ may be approximately b/3, wherein b is the semi-minor axis length of the DR) from post 652*a* and interface with ground plane 620 (e.g., soldered to a surface of the ground plane). Embodiments of the invention may, for example, utilize posts having a diameter of less than 3 mm to facilitate flat antenna gain in the passband. Posts 652*a*-652*c* are each interfaced with plate 651 (e.g., soldered to a surface of the plate), thereby forming two loops of the loop feed structure. Plate 651 of embodiments is provided in a "V" configuration having a flare angle of $\alpha_1$ as shown in FIG. 6C (e.g., $\alpha_1$ may be in the range of 90° and 180°) for implementing a loop feed structure facilitating excitation of CP fields. The flare angle implemented according to embodiments determines the orientation of equivalent magnetic dipoles of the loop structure, thus facilitating desired filtering performance. It should be set between 90° and 180°.

An exemplary implementation of a CP FDRA configured in accordance with FDRA 600 above was designed for operation at the 2.4 GHz WLAN band. ANSYS HFSS, high frequency electromagnetic field simulation software, was used to design the DRA of this exemplary FDRA implementation. In particular, a prototype CP FDRA, configured in accordance with FIGS. 6A-6C with the parameters $\alpha$=23.35 mm, b=18 mm, h=17.4 mm, d=2 mm, t=1.57 mm, $R_g$=55 mm, r=4.7 mm, $L_p$=11.2 mm, $W_p$=4.1 mm, $L_m$=6.5 mm, $L_n$=11 mm, $W_n$=4.74 mm, $L_s$=22 mm, $W_s$=4.7 mm, $\alpha_1$=120°, $e_r$=10, and $e_{rs}$=2.33, was fabricated.

Figure 7:
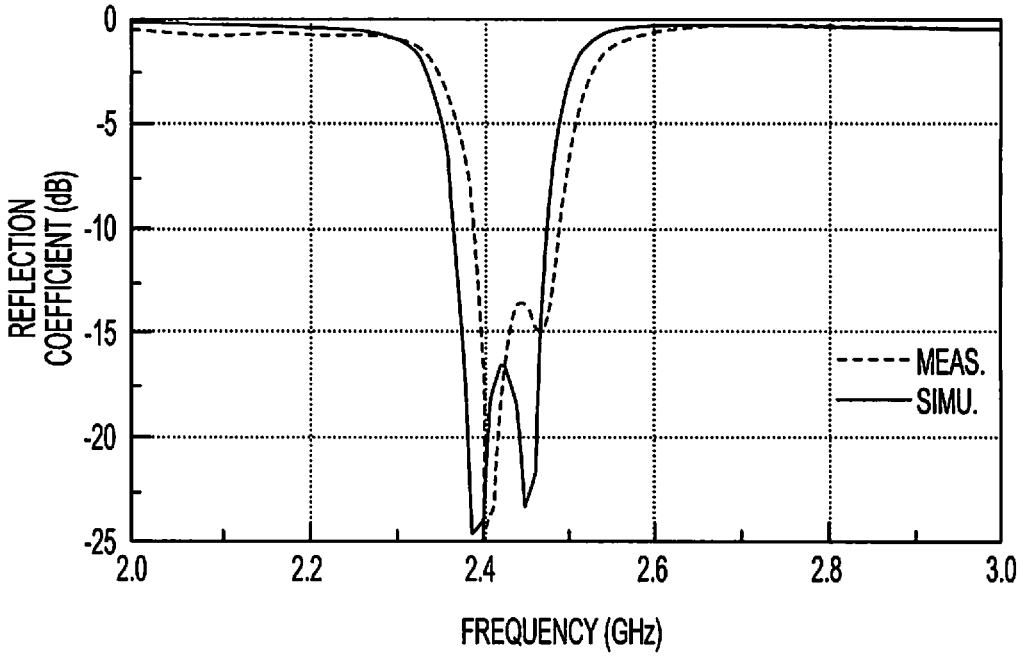
FIG. 7 shows the measured and simulated reflection coefficients of an exemplary implementation of a circular polarized filtering dielectric resonator antenna.

The reflection coefficient for the exemplary CP FDRA implementation was measured using an Agilent 8753ES vector network analyzer. FIG. 7 shows the measured (i.e. MEAS.) and simulated (i.e. SIMU.) reflection coefficients in dB vs. Frequency in GHz of the exemplary CP FDRA, wherein it can be seen that the measured and simulated results agree well with each other. The impedance bandwidths ($|S_{11}| \leq -10$ dB) of the measured and simulated reflection coefficients are given by 4.1% (2.39-2.49 GHz) and 4.5% (2.37-2.48 GHz), respectively. Similar to the exemplary LP FDRA implementation discussed above, the exemplary CP FDRA implementation provide sharp roll-off rate at the passband edge, with nearly total reflection in the stopband.

Figure 8:
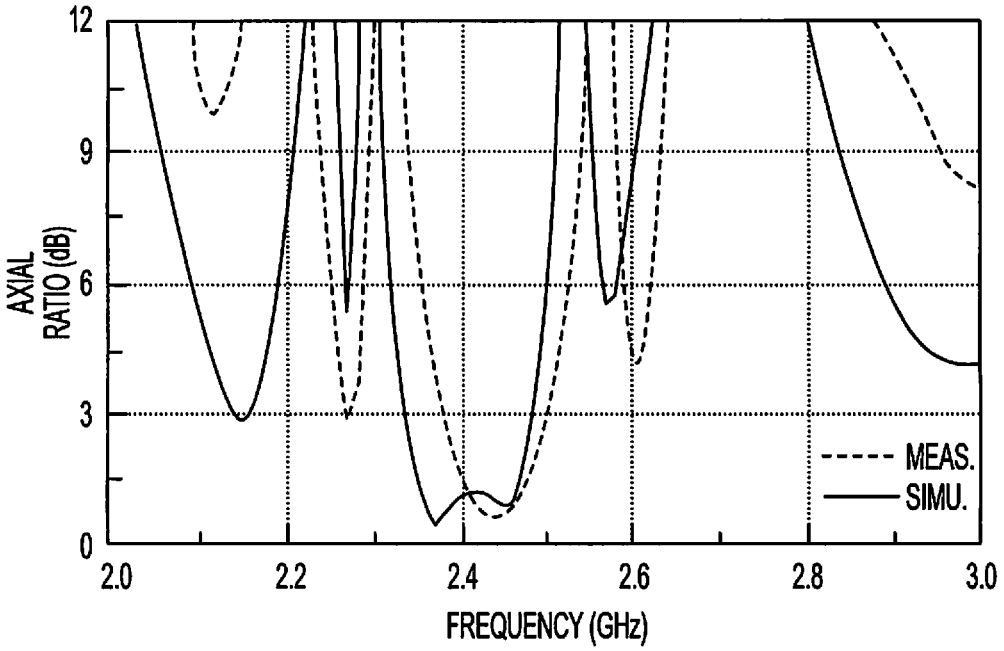
FIG. 8 shows the measured and simulated axial ratios in the boresight direction of an exemplary implementation of a circular polarized filtering dielectric resonator antenna.

FIG. 8 shows the measured (i.e. MEAS.) and simulated (i.e. SIMU.) axial ratios (ARs) in dB vs. Frequency in GHz in the boresight direction ($\theta$=0°). The measured and simulated 3-dB AR bandwidths are 4.9% (2.38-2.5 GHz) and 6.1% (2.34-2.49 GHz), respectively. It should be appreciated that overlapping bandwidths between 10-dB impedance and 3-dB AR are 4.1% (2.39-2.49 GHz) and 4.5% (2.37-2.48 GHz) are provided in the measurement and simulation respectively, which can both cover the entire 2.4 GHz WLAN band.

Figure 9:
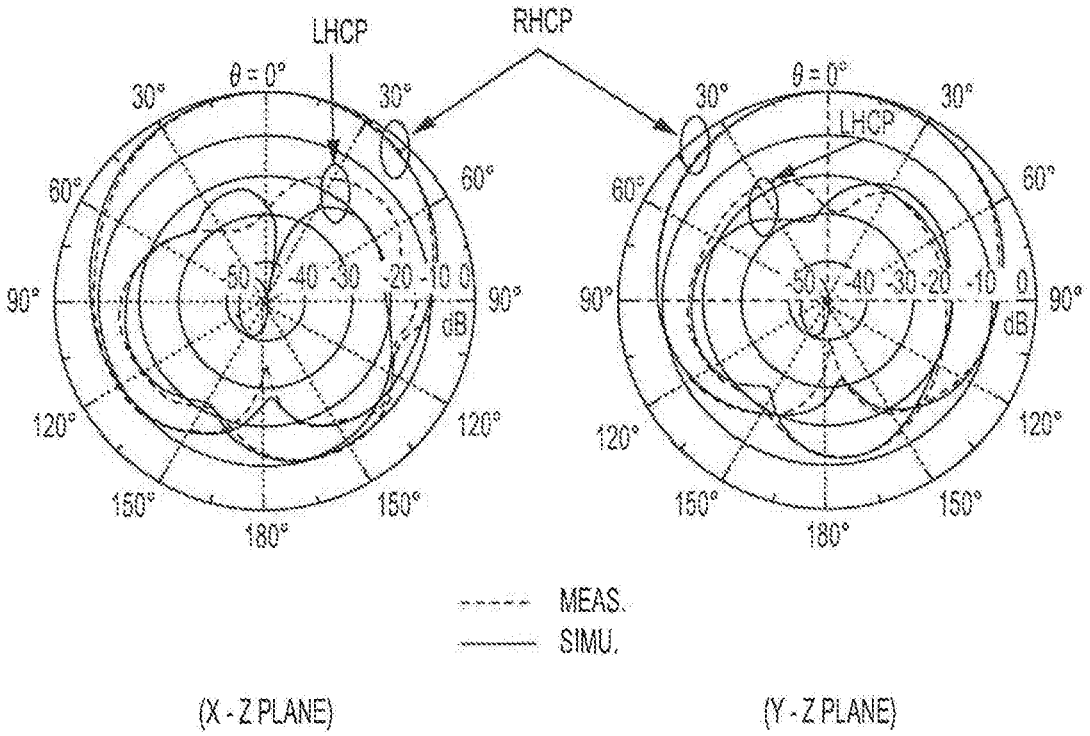
FIG. 9 shows the measured and simulated normalized radiation patterns of an exemplary implementation of a circular polarized filtering dielectric resonator antenna.

The antenna gain, antenna efficiency, and radiation pattern for the exemplary CP FDRA implementation were measured using a Satimo StarLab system. The measured (i.e. MEAS.) and simulated (i.e. SIMU.) normalized radiation patterns of the DRA at 2.45 GHz are shown in FIG. 9. As may be seen in the X-Z plane and Y-Z plane graphs of FIG. 9, the measured and simulated radiation patterns at 2.45 GHz are in good agreement. Broadside radiation patterns are obtained as expected and the co-polarized (i.e., Co-pol) (RHCP) field is more than 28 dB stronger than its cross-polarized (i.e., X-pol) counterpart (LHCP) in the boresight direction.

Figure 10:
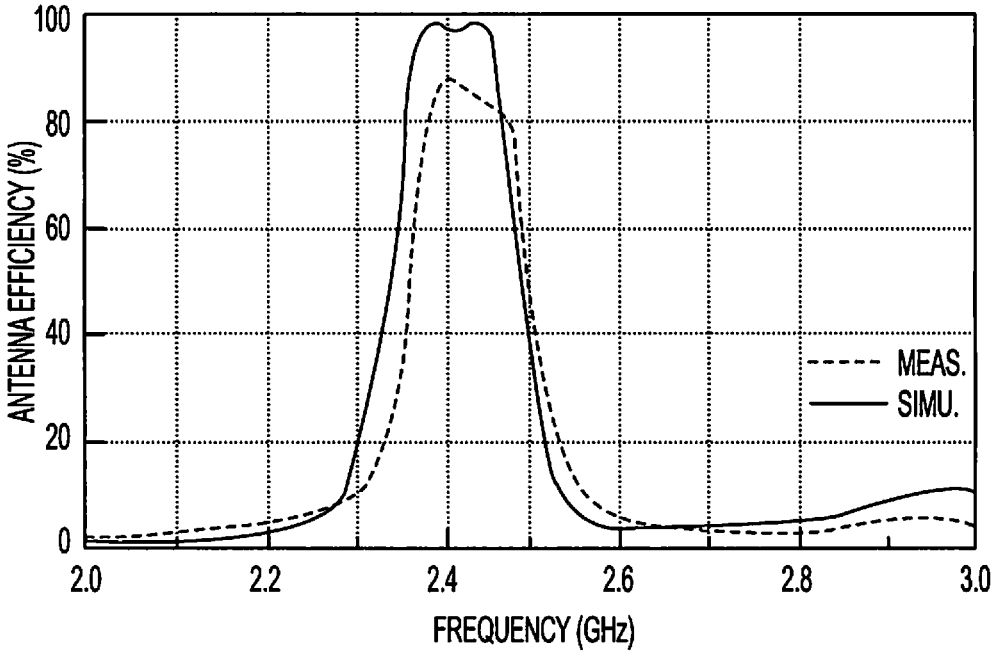
FIG. 10 shows the measured and simulated total antenna efficiency of an exemplary implementation of a circular polarized filtering dielectric resonator antenna.

The measured (i.e. MEAS.) and simulated (i.e. SIMU.) total antenna efficiency in % vs. Frequency in GHz for the exemplary CP FDRA is shown in FIG. 10, wherein it may be seen that reasonable agreement between the two is shown. As can be observed from the graphs of FIG. 10, the efficiency versus frequency curves are very steep which is desirable for filtering antennas. The measured efficiency has a maximum of 88.8% at 2.41 GHz, while it is quite small in the stopband. This is consistent with the fact that the reflection coefficients are nearly 0 dB in the stopband, as shown in FIG. 7.

Figure 11:
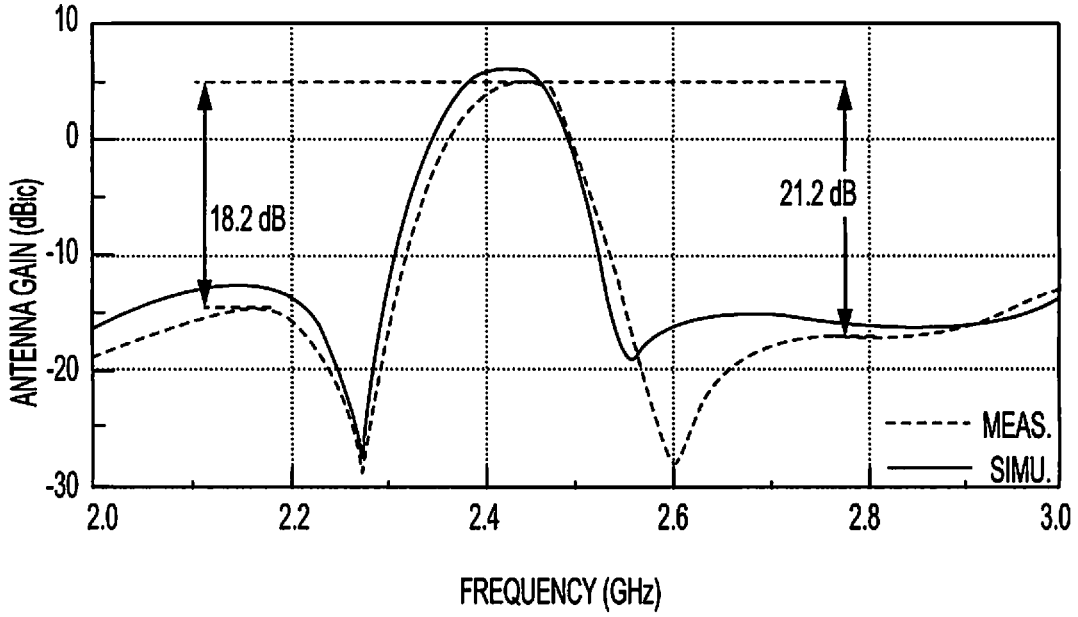
FIG. 11 shows the measured and simulated antenna gains of an exemplary implementation of a circular polarized filtering dielectric resonator antenna.

FIG. 11 shows the measured (i.e. MEAS.) and simulated (i.e. SIMU.) antenna gains of the exemplary CP FDRA antenna in the boresight direction in dBic vs. Frequency in GHz. Again, reasonable agreement between the measured and simulated results is obtained. As may be seen in FIG. 11, the measured and simulated peak gains are 5.1 and 6.3 dBic at 2.44 GHz and 2.45 GHz, respectively. It should be appreciated that measured antenna gain is lower than the simulated result due to the experimental imperfections, which are not taken into account in simulation. Radiation nulls of −28.2 and −27 dB are found at 2.27 and 2.61 GHz respectively in the measurement which are attributable to cancellation of two opposite equivalent magnetic dipoles (e.g., opposite-phase equivalent magnetic dipoles of embodiments of the invention). Measured out-of-band suppression levels of more than 18.2 dB and 21.2 dB in the lower and upper stopbands can be also obtained respectively.

The foregoing exemplary CP FDRA implementation illustrates that FDRAs configured in accordance with concepts of the present invention provide circular polarized antennas having excellent filtering functionality. It should be appreciated that CP FDRAs of embodiments of the invention are well suited to situations were circular polarized transmission is needed to resist interference, such as in satellite communications systems.

Embodiments of FDRAs in accordance with concepts of the present invention have been discussed with reference to radiation patterns and exciting the DR and/or loop feed structure. It should be understood that such references are not limited to excitation of FDRAs to provide radiation of signals in a transmit mode, but also references excitation of FDRAs in association with a signal received by the FDRA. That is, FDRAs of embodiments herein may be utilized with respect to signal transmission and/or signal reception.

Although a single instance of a FDRA has been referenced in the foregoing examples, it should be appreciated that FDRAs of embodiments herein may be utilized in an array comprising multiple instances of FDRAs as well as in a stand-alone antenna element configuration. For example, a plurality of FDRAs may be arranged in one or more columns and/or rows to provide a phased array antenna system. Additionally or alternatively, FDRAs of different polarizations (e.g., LP and CP) may be utilized in an antenna system for accommodating communication using variously polarized signals.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A filtering dielectric resonator antenna comprising:

a dielectric resonator configured to produce a first horizontal magnetic dipole; and a loop feed structure configured to produce a second horizontal magnetic dipole, wherein the first horizontal magnetic dipole and the second horizontal magnetic dipole are opposite-phase equivalent magnetic dipoles providing filtering functionality of the filtering dielectric resonator antenna through radiation cancellation.

2. The filtering dielectric resonator antenna of claim 1, wherein the opposite-phase equivalent magnetic dipoles have a same magnitude and opposite phase at one or more frequencies outside a passband of the filtering dielectric resonator antenna.

3. The filtering dielectric resonator antenna of claim 1, wherein the radiation cancellation produces one or more radiation nulls through combining of the first magnetic dipole and the second magnetic dipole.

4. The filtering dielectric resonator antenna of claim 1, wherein the dielectric resonator produces the first magnetic dipole when excited in a hybrid electromagnetic (HEM) mode.

5. The filtering dielectric resonator antenna of claim 4, wherein the HEM mode is a $HEM_{11\delta}$ mode.

6. The filtering dielectric resonator antenna of claim 1, wherein the loop feed structure comprises:

a conductive loop assembly, wherein at least a portion of the conductive loop assembly penetrates the dielectric resonator.

7. The filtering dielectric resonator antenna of claim 6, wherein the at least a portion of the conductive loop assembly that penetrates the dielectric resonator comprises:

a first portion extending through the dielectric resonator and interfacing with a signal feed path of the filtering dielectric resonator antenna; and a second portion extending through the dielectric resonator and interfacing with a ground plane of the filtering dielectric resonator antenna.

8. The filtering dielectric resonator antenna of claim 7, wherein at least another portion of the conductive loop assembly is disposed external to the dielectric resonator, and wherein the at least another portion of the conductive loop assembly that is disposed external to the dielectric resonator is coupled to each of the first portion extending through the dielectric resonator and the second portion extending through the dielectric resonator.

9. The filtering dielectric resonator antenna of claim 7, wherein the at least a portion of the conductive loop assembly that penetrates the dielectric resonator further comprises:

a third portion extending through the dielectric resonator and interfacing with the ground plane of the filtering dielectric resonator antenna.

10. The filtering dielectric resonator antenna of claim 7, wherein the signal feed path is used to excite both the dielectric resonator and the conductive loop assembly.

11. The filtering dielectric resonator antenna of claim 1, wherein the dielectric resonator and the loop feed structure are configured for linear polarization to thereby provide a linear polarized filtering dielectric resonator antenna.

12. The filtering dielectric resonator antenna of claim 1, wherein the dielectric resonator and the loop feed structure are configured for circular polarization to thereby provide a circular polarized filtering dielectric resonator antenna.

13. A method for providing filtering antenna operation, the method comprising:

generating a first horizontal magnetic dipole from excitation of a dielectric resonator of a filtering dielectric resonator antenna;

generating a second horizontal magnetic dipole from excitation of a loop feed structure of the filtering dielectric resonator antenna, wherein the first horizontal magnetic dipole and the second horizontal magnetic dipole are opposite-phase equivalent magnetic dipoles; and providing filtering of one or more frequencies outside of a passband of the filtering dielectric resonator antenna through radiation cancellation resulting from combining of the first horizontal magnetic dipole and the second horizontal magnetic dipole.

14. The method of claim 13, wherein the opposite-phase equivalent magnetic dipoles have a same magnitude and opposite phase at the one or more frequencies outside the passband of the filtering dielectric resonator antenna.

15. The method of claim 13, wherein the radiation cancellation produces one or more radiation nulls.

16. The method of claim 13, wherein the generating the first magnetic dipole from excitation of the dielectric resonator comprises:

exciting the dielectric resonator in a hybrid electromagnetic (HEM) mode.

17. The method of claim 16, wherein the HEM mode is a $HEM_{11\delta}$ mode.

18. The method of claim 13, wherein the loop feed structure includes at least a portion of which penetrates the dielectric resonator.

19. The method of claim 18, wherein the at least a portion of the loop feed structure that penetrates the dielectric resonator includes a first portion extending through the dielectric resonator and interfacing with a signal feed path of the filtering dielectric resonator antenna and a second portion extending through the dielectric resonator and interfacing with a ground plane of the filtering dielectric resonator antenna.

20. The method of claim 19, wherein at least another portion of the loop feed structure is disposed external to the dielectric resonator, and wherein the at least another portion of the loop feed structure that is disposed external to the dielectric resonator is coupled to each of the first portion extending through the dielectric resonator and the second portion extending through the dielectric resonator.

21. The method of claim 19, wherein the at least a portion of the loop feed structure that penetrates the dielectric resonator further includes a third portion extending through the dielectric resonator and interfacing with the ground plane of the filtering dielectric resonator antenna.

22. The method of claim 19, further comprising:

using the signal feed path to excite the dielectric resonator to generate the first magnetic dipole and to excite the loop feed structure to generate the second magnetic dipole.

23. The method of claim 13, wherein the dielectric resonator and the loop feed structure are configured for linear polarization to thereby provide a linear polarized filtering dielectric resonator antenna.

24. The method of claim 13, wherein the dielectric resonator and the loop feed structure are configured for circular polarization to thereby provide a circular polarized filtering dielectric resonator antenna.

25. A filtering antenna system, the system comprising:

a ground plane disposed upon a first side of a substrate, the ground plane including a slot disposed therein;

a signal feed path disposed upon a second side of the substrate and forming a microstrip feed line, the microstrip feed line being disposed in juxtaposition with the slot of the ground plane;

a dielectric resonator disposed upon the ground plane, wherein the dielectric resonator is in communication with the microstrip feed line through the slot of the ground plane to thereby provide a slot-fed dielectric resonator antenna structure, and wherein the slot-fed dielectric resonator antenna structure is configured to produce a first horizontal magnetic dipole; and a loop feed structure, wherein at least a portion of the loop feed structure penetrates the dielectric resonator, wherein a first end of the loop feed structure is in communication with the microstrip feed line through the slot of the ground plane and a second end of the loop feed structure is in communication with the ground plane, and wherein the loop feed structure is configured to produce a second horizontal magnetic dipole, wherein the first horizontal magnetic dipole and the second horizontal magnetic dipole have a same magnitude and opposite phase at one or more frequencies outside a filtering antenna passband and filter one or more frequencies outside of the filtering antenna passband through radiation cancellation.

26. The system of claim 25, wherein the slot-fed dielectric resonator antenna structure produces the first horizontal magnetic dipole when excited in a hybrid electromagnetic (HEM) mode.

27. The system of claim 25, wherein at least another portion of the loop feed structure is disposed external to the dielectric resonator, and wherein the at least another portion of the loop feed structure that is disposed external to the dielectric resonator is coupled to a first portion of the loop feed structure extending through the dielectric resonator having the first end in communication with the microstrip feed line and a second portion of the loop feed structure extending through the dielectric resonator having the second end in communication with the ground plane.

28. The system of claim 27, wherein a third end of the loop feed structure is in communication with the ground plane, and wherein the at least another portion of the loop feed structure that is disposed external to the dielectric resonator is coupled to a third portion of the loop feed structure extending through the dielectric resonator having the third end in communication with the ground plane.

29. The system of claim 25, wherein the dielectric resonator antenna structure and the loop feed structure are configured for linear polarization to thereby provide a linear polarized filtering antenna.

30. The system of claim 25, wherein the dielectric resonator antenna structure and the loop feed structure are configured for circular polarization to thereby provide a circular polarized filtering antenna.

* * * * *